US011020628B2

(12) United States Patent
Park et al.

(10) Patent No.: US 11,020,628 B2
(45) Date of Patent: Jun. 1, 2021

(54) DISPLAY DEVICE AND CONTROL METHOD THEREFOR

(71) Applicant: SAMSUNG ELECTRONICS CO., LTD., Suwon-si (KR)

(72) Inventors: An-na Park, Suwon-si (KR); Byung-jun Son, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 315 days.

(21) Appl. No.: 16/061,402

(22) PCT Filed: Dec. 30, 2016

(86) PCT No.: PCT/KR2016/015562

§ 371 (c)(1),
(2) Date: Jun. 12, 2018

(87) PCT Pub. No.: WO2017/122957

PCT Pub. Date: Jul. 20, 2017

(65) Prior Publication Data

US 2020/0261763 A1 Aug. 20, 2020

(30) Foreign Application Priority Data

Jan. 12, 2016 (KR) ..... 10-2016-0003801

(51) Int. Cl.

| | |
|---|---|
| ***A63B 22/02*** | (2006.01) |
| ***A63B 24/00*** | (2006.01) |
| ***A63B 71/06*** | (2006.01) |

(52) U.S. Cl.

CPC ..... *A63B 22/02* (2013.01); *A63B 24/00* (2013.01); *A63B 71/0619* (2013.01); *A63B 2220/833* (2013.01)

(58) Field of Classification Search

CPC ..... A63B 22/02; A63B 22/04; A63B 22/06; A63B 22/0605; A63B 22/0664;

(Continued)

(56) References Cited

U.S. PATENT DOCUMENTS 6,024,675 A * 2/2000 Kashiwaguchi ..... A63F 13/95 482/4
6,102,832 A * 8/2000 Tani ..... G06F 3/011 482/4

(Continued)

FOREIGN PATENT DOCUMENTS

KR 10-0819205 4/2008
KR 10-1168207 7/2012

(Continued)

OTHER PUBLICATIONS

International Search Report for PCT/KR2016/015562, with English Translation, dated Mar. 31, 2017, 5 pages.

(Continued)

*Primary Examiner* — Gary D Urbiel Goldner
(74) *Attorney, Agent, or Firm* — Nixon & Vanderhye, P.C.

(57) ABSTRACT

The present invention relates to a display device including a communicator configured to communicate with an external apparatus that operates for a workout of a user; a display configured to display an image; and a controller configured to determine workout conditions of the user, and control the communicator to transmit a control signal to the external apparatus so that the display can display a corresponding image and the external apparatus can change the operation in accordance with the determined workout conditions of the user.

13 Claims, 18 Drawing Sheets

(58) Field of Classification Search
CPC ..... A63B 24/0059; A63B 24/0062; A63B 24/0084; A63B 24/0087; A63B 2024/0065; A63B 2024/0068; A63B 2024/0071; A63B 2024/009; A63B 2024/0093; A63B 2024/0096; A63B 1/0619; A63B 1/0622; A63B 2071/065; A63B 2071/0658; A63B 2071/0661; A63B 2071/0666; A63B 2071/0675; A63B 2220/18; A63B 2220/20; A63B 2220/30; A63B 2220/40; A63B 2220/50; A63B 2220/51; A63B 2220/52; A63B 2220/64; A63B 2220/80; A63B 2220/83; A63B 2220/833; A63B 2225/50; A63B 2225/52; A63B 2225/54; A63B 2230/01; A63B 2230/015; A63B 2230/04; A63B 2230/045; A63B 2230/06; A63B 2230/062; A63B 2230/065; A63B 2230/067; A63B 2230/30; A63B 2230/305; A63B 2230/50; A63B 2230/505; A63B 2230/62; A63B 2230/625
See application file for complete search history.

(56) References Cited

U.S. PATENT DOCUMENTS 6,705,972 B1 * 3/2004 Takano ..... A63B 71/0622 482/8
6,749,432 B2 * 6/2004 French ..... A61B 5/1113 434/247
7,980,997 B2 * 7/2011 Thukral ..... A63B 24/0059 463/1
9,011,293 B2 * 4/2015 Shavit ..... A63B 71/0622 482/8
9,375,629 B2 * 6/2016 Schieffer ..... A63B 71/0622
2001/0001303 A1 * 5/2001 Ohsuga ..... A63F 13/28 482/5
2003/0181291 A1 * 9/2003 Ogawa ..... A63B 24/00 482/8
2005/0221960 A1 * 10/2005 Miyamaru ..... A63B 22/0605 482/57
2006/0286522 A1 * 12/2006 Ng-Thow-Hing ..... G09B 23/28 434/247
2007/0003915 A1 * 1/2007 Templeman ..... G06F 3/011 434/247
2007/0042868 A1 * 2/2007 Fisher ..... B62D 1/02 482/8
2008/0139307 A1 * 6/2008 Ueshima ..... A63F 13/10 463/31
2009/0011907 A1 * 1/2009 Radow ..... B62M 3/00 482/57
2009/0029769 A1 * 1/2009 Muller ..... A63F 13/816 463/31
2010/0105525 A1 * 4/2010 Thukral ..... A63B 24/0059 482/8
2011/0021317 A1 * 1/2011 Lanfermann ..... A61B 5/0002 482/8
2011/0092260 A1 * 4/2011 Murdock ..... A63B 24/0084 463/3
2011/0270135 A1 * 11/2011 Dooley ..... A61B 5/1114 600/595
2012/0142415 A1 6/2012 Lindsay
2012/0142497 A1 * 6/2012 Ishii ..... A63B 21/0056 482/4
2013/0336629 A1 12/2013 Mulholland et al.
2014/0073481 A1 * 3/2014 Aibara ..... A61B 5/681 482/1
2014/0113770 A1 * 4/2014 Yim ..... A63B 22/0023 482/8
2015/0209617 A1 * 7/2015 Hsiao ..... A63B 24/0084 482/4
2016/0023081 A1 * 1/2016 Popa-Simil ..... B62M 1/32 700/91

FOREIGN PATENT DOCUMENTS

KR 10-1233861 2/2013
KR 10-2015-0057448 5/2015

OTHER PUBLICATIONS

Written Opinion of the ISA for PCT/KR2016/015562, dated Mar. 31, 2017, 5 pages.

* cited by examiner

START: WITH LOW OPERATION LEVEL OF EXERCISE STEPPER

START: WITH MIDDLE OPERATION LEVEL OF EXERCISE STEPPER

START: WITH HIGH OPERATION LEVEL OF EXERCISE STEPPER

DISPLAY DEVICE AND CONTROL METHOD THEREFOR

This application is the U.S. national phase of International Application No. PCT/KR2016/015562 filed Dec. 30, 2016, which designated the U.S. and claims priority to KR Patent Application No. 10-2016-0003801 filed Jan. 12, 2016, the entire contents of each of which are hereby incorporated by reference.

TECHNICAL FIELD

The present invention relates to a display device, which makes an operation level of an exercise apparatus be varied depending on workout conditions of a user and provides an image corresponding to the workout conditions of the user to thereby give senses of immersion and realism to the user, and a control method thereof.

DESCRIPTION OF RELATED ART

Increasingly, a user works out indoors with an exercise apparatus. In case of using the exercise apparatus to do a workout inside a door, a user has to control the exercise apparatus one by one when the user becomes tired as time passes from the workout or when the user increases workout intensity after doing the workout with low intensity. For example, when a user uses a treadmill to do a running workout, the user has to control the speed, incline, etc. of the treadmill. However, it may be difficult for a user to control the exercise apparatus while doing the workout.

Further, a user may listen to music or watch an image through a screen while doing a workout, but this does not immerse the user in the workout. For example, in a case where a user does a walking workout with an exercise stepper, it is difficult for the user to feel immersion and realism since not a realistic image looking as if taken while climbing a mountain of scenic beauty but a related image is provided on a small screen supported by the exercise apparatus.

SUMMARY

An object of the present invention is to provide a display device, which makes an operation level of an exercise apparatus be varied depending on workout conditions of a user and provides an image corresponding to the workout conditions of the user, and a control method thereof.

The display device conceived to solve the problems of the present invention includes: a communicator configured to communicate with an external apparatus that operates for a workout of a user; a display configured to display an image; and a controller configured to determine workout conditions of the user, and control the communicator to transmit a control signal to the external apparatus so that the display can display a corresponding image and the external apparatus can be varied in operation in accordance with the determined workout conditions of the user.

Here, the controller may determine the workout conditions of the user based on information about an operation level of the external apparatus received from the external apparatus.

Further, the display device may further comprise a sensor configured to sense situations of the user, wherein the controller determines the workout conditions of the user based on the situations of the user sensed by the sensor.

Here, the controller may determine the workout conditions of the user based on information about a body of the user sensed by the sensor.

Further, the controller may control an image including a workout-related image to be varied and displayed depending on change in the workout conditions of the user.

Here, the controller may control the image to be displayed corresponding to the kinds of external apparatus that transmits an operation level.

Further, the controller may control images of related users including the user, who do a workout with the external apparatus, to be displayed corresponding to a workout time of the user.

Here, the controller may control guide information to be displayed including workout and health conditions of the user.

Further, the controller may control the external apparatus to be varied in an operation level depending on change in the workout conditions of the user.

Here, the controller may control the operations of the external apparatus in accordance with received information about the operations of the external apparatus.

Further, the controller may control a user image to be stored including a workout history and a workout image of the user.

Here, the display device may further include an audio receiver configured to receive a voice command of the user; and an image pickup unit configured to pick up a gesture of the user, and the controller may set the user's command with regard to at least one of the voice command and the gesture of the user.

Meanwhile, a method of controlling a display device conceived to solve the problems of the present invention includes: determining workout conditions of a user; displaying a corresponding image based on the determined workout conditions of the user; and controlling the external apparatus to be varied in operation.

Here, the step of determining the workout conditions of the user may comprise a step of determining the workout conditions of the user based on information about an operation level of the external apparatus received from the external apparatus.

Further, the step of determining the workout conditions of the user may comprise a step of determining the workout conditions of the user based on sensed situations of the user.

Here, the step of determining the workout conditions of the user may comprise a step of determining the workout conditions of the user based on sensed information about a body of the user by the sensor.

Further, the step of displaying the corresponding image may comprise a step of controlling an image including a workout-related image to be varied and displayed depending on change in the workout conditions of the user.

Here, the step of displaying the corresponding image may comprise a step of controlling the image to be displayed corresponding to the kinds of external apparatus that transmits an operation level.

Further, the step of displaying the corresponding image may comprise a step of controlling images of related users including the user, who do a workout with the external apparatus, to be displayed corresponding to a workout time of the user.

Here, the step of displaying the corresponding image may comprise a step of controlling guide information to be displayed including workout and health conditions of the user.

Further, the step of displaying the corresponding image may comprise a step of controlling the external apparatus to be varied in an operation level depending on change in the workout conditions of the user.

Here, the step of controlling the external apparatus to be varied in the operation level may comprise a step of controlling the operations of the external apparatus in accordance with received information about the operations of the external apparatus.

Further, the method may further comprise a step of controlling a user image to be stored including a workout history and a workout image of the user.

Further, the method may further include a step of setting the user's command with regard to at least one of the voice command and the gesture of the user.

According to the present invention, operations of an exercise apparatus are readily changed in accordance with workout conditions of a user while the user does a workout with the exercise apparatus, thereby having effects on promoting senses of immersion and realism in the workout.

DETAILED DESCRIPTION OF EXAMPLE EMBODIMENTS

Below, the present invention will be described in detail with reference to accompanying drawings.

Figure 1:
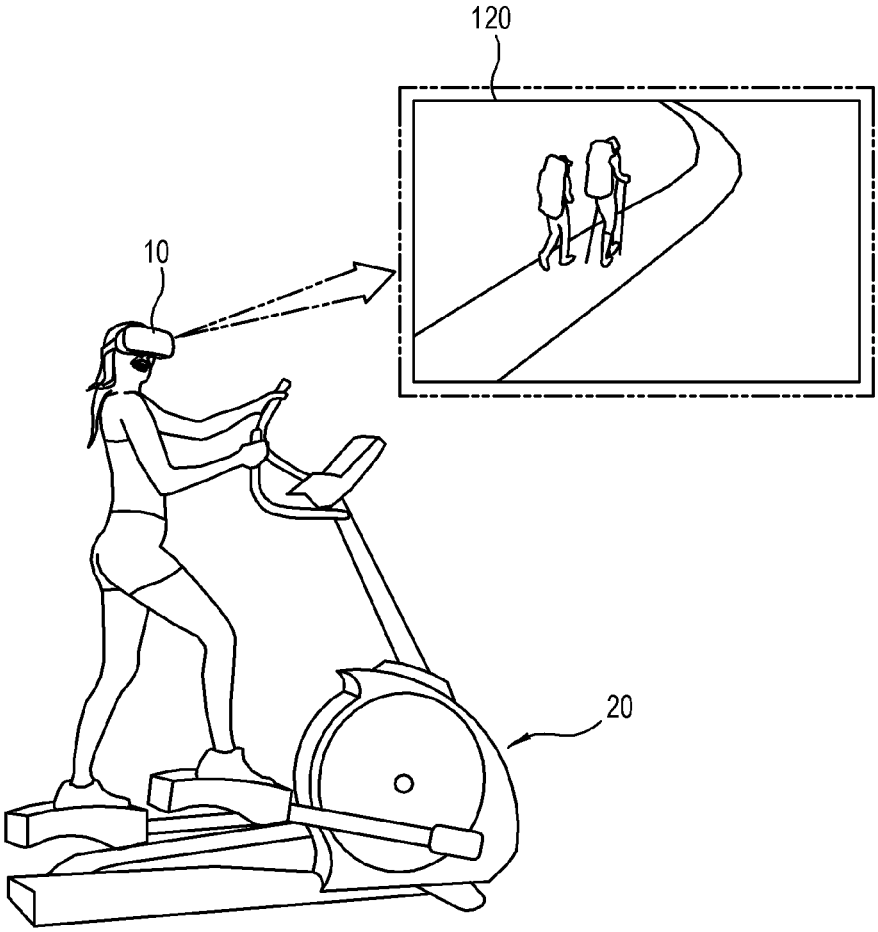
FIG. 1 illustrates an example that a user does a workout with a display device according to one embodiment of the present invention.

FIG. 1 illustrates an example that a user does a workout with a display device 10 according to one embodiment of the present invention.

A user who wears a head-mounted display device 10 is doing a workout with an exercise stepper 20. A user may make an image be displayed corresponding to an exercise apparatus used for a workout. When a user selects an exercise apparatus corresponding to a workout through the display device 10, the display device 10 provides an image, which is related to the selected exercise apparatus and the speed and the like of the exercise apparatus, to the user through a display 120 of the display device 10. Referring to FIG. 1, a user uses the exercise stepper 20 to do a hiking workout, and the display 120 of the display device 10 provides an image of starting hiking and walking on a flatland at an entrance of a climbing route In FIG. 1, the exercise stepper 20 and the hiking image are illustrated, but not limited thereto. Besides, various kinds of exercise apparatuses 20 and other related images may be provided.

Figure 2:
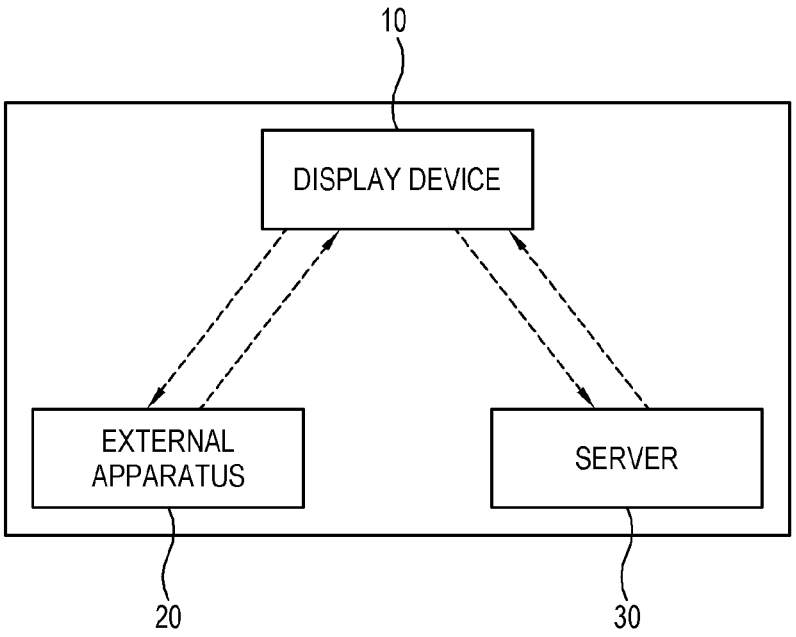
FIG. 2 illustrates an example of control signals flowing among a display device, an exercise apparatus and an external server according to one embodiment of the present invention.

FIG. 2 illustrates an example of control signals flowing among a display device 10, an exercise apparatus 20 and an external server 30 according to one embodiment of the present invention.

A user may make pairing for communication between the head-mounted display device 10 and the exercise apparatus 20. The pairing may be automatically performed by executing an application program in the display device 10. The display device 10 may be automatically paired with a registered and near exercise apparatus 20, and may be paired with an exercise apparatus 20 corresponding to a workout in response to a user's input. On a screen of displaying the application program of the display device 10, the exercise apparatuses 20 for the pairing are displayed for allowing a user to select a desired exercise apparatus 20. After the pairing between the display device 10 and the exercise apparatus 20, a user begins the workout with the exercise apparatus 20. The display device 10 may determine workout conditions of a user based on information about an operation level of the exercise apparatus 20 received from the exercise apparatus 20, sensed situations of the user, and sensed information about a user's body. In accordance with the determined workout conditions, the display device 10 transmits a control signal for controlling the exercise apparatus 20 to have an operation level corresponding to the workout conditions. Thus, the exercise apparatus 20 changes the operation level in accordance with the workout conditions of a user. When a workout speed of a user becomes slower, a control signal is made for decreasing the speed, incline, etc. of the exercise apparatus 20 and transmitted to the exercise apparatus 20, so that the exercise apparatus 20 can operate with the decreased speed, incline, etc. On the other hand, when the workout speed of a user becomes faster, a control signal is made for increasing the speed, incline, etc. of the exercise apparatus 20 and transmitted to the exercise apparatus 20, so that the exercise apparatus 20 can operate with the increased speed, incline, etc.

A user may store information about a history of a workout that has been done using the exercise apparatus 20. The information may be stored in a storage 150 of the display device 10 or in the external server. A user may access the external server and download information stored by a plurality of other users before starting a workout, so that a workout image corresponding to the downloaded information, for example, an image of a competition mode can be displayed. When a user downloads information about a 100 m race, stored by the plurality of other users, an image of before starting the 100 m race, i.e. an image including the user's own image is displayed on the display 120 of the display device 10, so that an downloaded image including the plurality of other users can be reproduced in response to a specific signal while reproducing the user's own image corresponding to the user's workout conditions. As described above, a user may do a workout while competing for the 100 m race with the plurality of other users. In this case, the competition may be carried out under the same conditions. These conditions may be set by a user and applied to a plurality of users. Further, a user downloads information of the same conditions stored by himself/herself, and does a workout while the image of the downloaded information is displayed. Content about each piece of information may be used as a diet program, and guide information about the content may be provided to encourage a user to do a workout. A user may access the external server so that storage can be achieved by the user's account, and other users may use their own accounts to achieve the access and storage.

Figure 3:
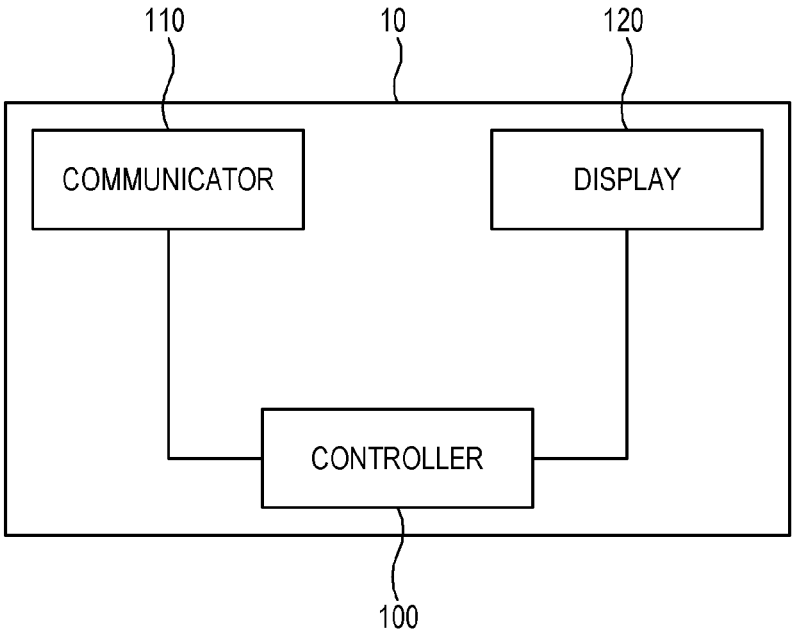
FIG. 3 is a block diagram of showing a configuration of a display device according to the present invention.

FIG. 3 is a block diagram of showing a configuration of the display device 10 according to the present invention. The display device 10 according to the present invention may include a communicator 110, a display 120 and a controller 100.

The communicator 110 may receive a signal caused by an external input and transmit it to a video processor 130 or the controller 100. The communicator 110 may connect with various external input cables to receive signals from corresponding external inputs by a wire, or receive signals through preset wireless communication standards wirelessly.

The communicator 110 may include a plurality of connectors (not shown) to which cables are individually connected. The communicator 110 may receive a signal from a connected external input, for example, a broadcast signal, an image signal, a data signal, etc. according to standards such as a high definition multimedia interface (HDMI), a universal serial bus (USB), Component, or may receive communication data through a communication network.

The communicator 110 may include not only a configuration for receiving a signal/data from an external input, but also various configurations such as a wireless communication module (not shown) for wireless communication, a tuner (not shown) for being tuned to a broadcast signal, etc. in accordance with the designs of the display device 10. The communicator 110 may not only receive a signal from the external apparatus but also transmit the information/data/a signal from the display device 10 to the external apparatus. That is, the communicator 110 is not limited to the configuration for receiving a signal in the external apparatus signal, but may be achieved by an interface capable of interactive communication. The communicator 110 may receive a control signal for selecting a UI from a plurality of control apparatuses. The communicator 110 may be materialized by communication modules for a publicly known near field communication such as BLUETOOTH, infrared (IR), ultra-wideband (UWB), ZIGBEE, or may be configured with a publicly known communication port for wired communication. The communicator 110 may be used for various purposes of transmitting and receiving a command, data or the like for controlling the display, as well as a control signal for selecting the UI.

The display 120 displays a processed image signal as an image in proximity to both eyes of a user. The display 120 may further include an element for operating as shutters to selectively transmit/block external light with regard to both eyes of a user. While no images are displayed, the shutters may operate to make a user to view the outside. The display 120 includes display elements for displaying the processed image signal as an image, and the display elements may be achieved by a liquid crystal display (LCD) panel. The display 120 is a head-mounted display device shaped like a goggle, and includes a display element, a total-reflection mirror for reflecting an image displayed on the display element, and a translucent mirror on which the image reflected from the total-reflection mirror is formed, details of which are omitted herein. Alternatively, the display 120 may be achieved by a three-side or omnidirectional surrounding display.

The controller 100 determines a user's workout conditions, and controls the communicator 110 to transmit a control signal to the external apparatus 20 so that the display 120 can display an image corresponding to the determined workout conditions and the external apparatus 20 change an operation.

Figure 4:
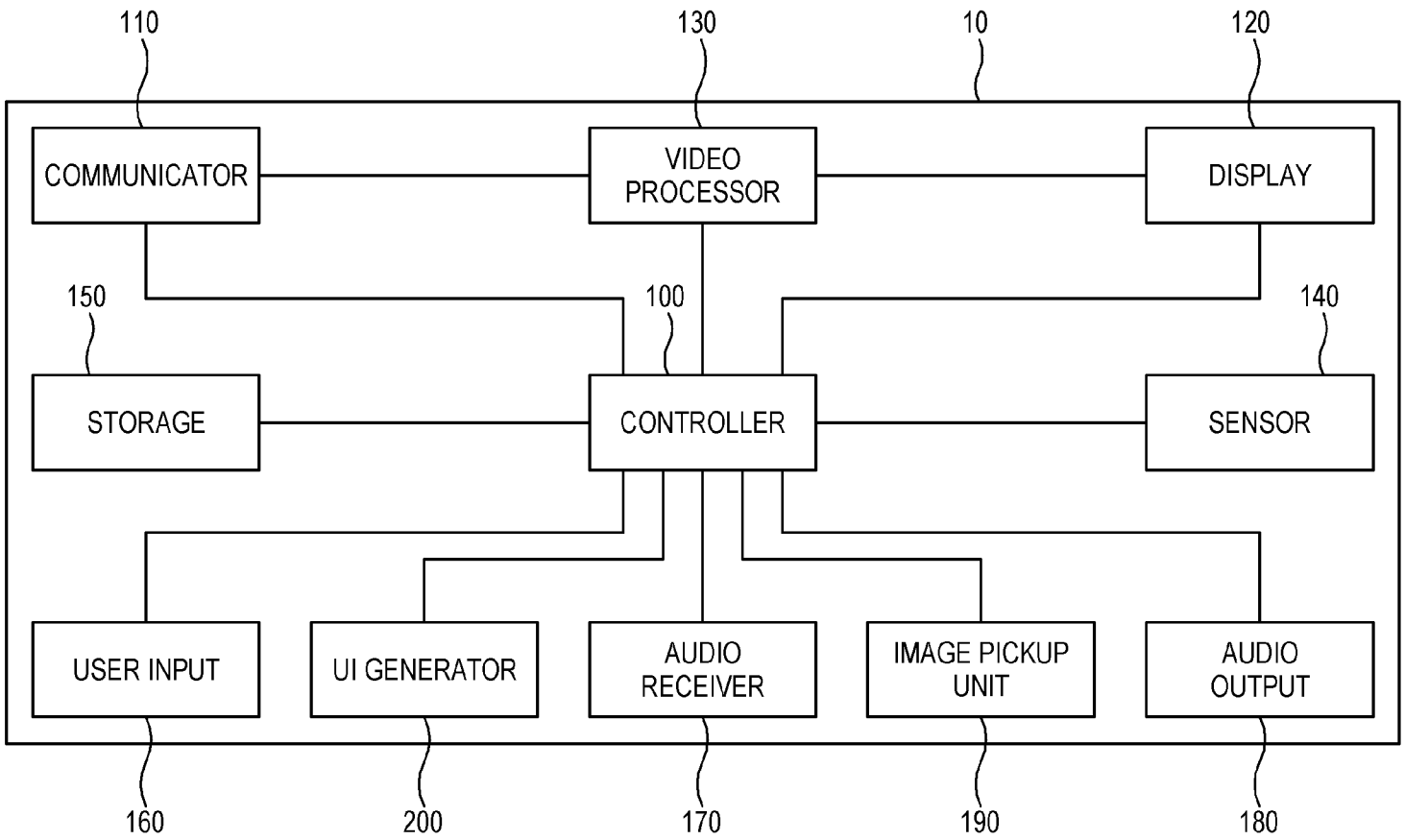
FIG. 4 is a block diagram of showing a configuration of a display device according to one embodiment of the present invention.

FIG. 4 is a block diagram of showing a configuration of the display device 10 according to one embodiment of the present invention. The display device 10 according to one embodiment of the present invention may have the configuration shown in FIG. 3, and may additionally include a video processor 130, a sensor 140, a storage 150, a user input 160, an audio receiver 170, an audio output 180, an image pickup unit 190, and a UI generator 200.

There are no limits to the kinds of image processing process to be performed in the video processor 130. For example, the image processing process includes de-multiplexing for dividing a predetermined signal into signals according to characteristics, decoding performed corresponding to a video format of an image signal, de-interlacing for converting an interlaced-type video signal into a progressive-type video signal, noise reduction for improving quality of an image, detail enhancement, frame refresh rate conversion, etc. To this end, the video processor 130 may further include a decoder (not shown) for decoding a source image in accordance with a video format of an encoded source image, and a frame buffer (not shown) for storing the decoded source images in units of frame.

The video processor 130 may be materialized by a system on chip (SoC) on which such various functions are integrated, or a video processing board (not shown) to which individual elements for independently performing these processes are mounted, and provided inside the display device 10.

The video processor 130 subjects various preset image processing processes to a broadcast signal including a video signal received from a receiver (not shown), and a source image including a video signal received from an image source (not shown). The video processor 130 outputs the video signal subjected to such process to the display device 10, so that a processed image can be displayed on the display device.

The sensor 140 may be provided to sense a user's situations. The sensor 140 may be configured as a sensor for sensing a balance, vibration, etc. and determining what workout a user is doing. The sensor 140 may be provided as a pulsimeter and a thermometer for taking pulses and body temperature of a user, and transmit information about the sensed pulses and body temperature of the user to the controller 100.

The storage 150 may be provided as a writable nonvolatile memory (e.g. a writable read only memory, ROM) in which pieces of data are retained even though the display device 10 is powered off, and a user's changes are reflected. That is, the storage 150 may be provided as one of a flash memory, an erasable programmable read only memory (EPROM) and an electrically erasable programmable read only memory (EEPROM). The storage 150 may be configured to store operations corresponding to a user's voice command and gesture. The storage 150 may be configured to store information about a user's workout, a workout image with the exercise apparatus 20, and workout history. The storage 150 may be configured to receive and store information about a user's medical history and body.

The user input 160 may transfer various preset control commands or information to the controller 100 in response to a user's control and input. The user input 160 may be materialized by a menu-key or input panel placed on an outer side of the display device 10, a remote controller separated from the display device 10, etc. Alternatively, the user input 160 may be integrated into the display 120. When the display 120 is provided as a touch-screen, the preset command may be transferred to the controller 100 as a user touches an input menu (not shown) displayed on the display 120.

The user input 160 may receive a user's motion and voice. The user's motion may include a touch input. The user input 160 may directly receive a user's motion and voice, or may receive information about a user's motion and voice from the external apparatus.

The audio receiver 170 may be materialized by a microphone and receive a sound including a user's voice, thereby transferring it to the controller 100.

The audio output 180 may be materialized by a loudspeaker and output a sound including a user's voice under control of the controller 100.

The image pickup unit 190 may be materialized by a camera and pick up an external image.

The UI generator 200 may generate a UI for operating an application program to be executed. The generated UI includes a plurality of sub UIs provided in the form of an icon, a text, etc. When a user selects a certain sub UI through the display device 10, an application program may operate corresponding to the selected sub UI. That is, each of the sub UIs may be generated in unit of plural functions or events for operating the application program being executed in the display device 10.

The UI generator 200 refers to a software or hardware function for generating and controlling the UI displayed on the display 120, and its function may be performed by the controller 100 to be described later. In other words, the UI generator 200 may be not configured as a separate chipset or a separate microprocessor.

The controller 100 may determine a user's workout conditions in accordance with information about an operation level of the external apparatus 10 received from the external apparatus 20.

The controller 100 may determine a user's workout conditions based on a user's situations sensed by the sensor 140.

The controller 100 may determine a user's workout conditions based on information about the user's body sensed by the sensor 140.

The controller 100 may control an image including a workout-related image to be varied and displayed depending on change in a user's workout conditions.

The controller 100 may control an image to be displayed corresponding to the kind of external apparatus 20 transmitting an operation level. For example, when the external apparatus 20 is an exercise stepper, a hiking image may be provided to a user. When the external apparatus 20 is an exercise apparatus for golf, a golf course image may be provided to a user.

The controller 100 may control an image, which shows a related user including a user does a workout with the external apparatus 20, to be displayed corresponding to a workout time of the user. The workout image of the related user including the user, stored in the storage 150 or the external server, is downloaded and displayed corresponding to a workout time of the user, so that the user can be in competition with each other while doing a workout.

The controller 100 may control guide information including a user's workout and health conditions to be displayed. In other words, the guide information is provided to take a user's health conditions into account during the workout. When a user who has a high blood pressure does a workout to some extent, guide information may be provided to avoid an immoderate workout. Of course, a user can control his/her exercise rate. However, when a user is faced with difficulty in controlling the exercise rate, a health problem may escalate. To prevent this problem, the exercise rate, speed, time, etc. may be set. Information about the exercise rate, speed, time, etc. may be periodically or continuously displayed.

The controller 100 may control the operation level of the external apparatus to be changed in accordance with a user's workout conditions. For example, in a case where a user employs the exercise stepper 20 to do a workout of climbing a mountain, the exercise stepper 20 is changed to decrease intensity and incline when a workout speed of the user becomes slower. The controller 100 may sense a stop of a user and control the communicator to transmit a control signal for decreasing the intensity and incline of the exercise stepper 20.

The controller 100 may control the operations of the external apparatus 20 in response to the information about the received operation of the external apparatus 20. A user's workout conditions may be determined based on information about the operation of the external apparatus 20, and the external apparatus 20 may operate more strongly. Further, the information about the operation of the external apparatus 20 may be used to set workout intensity of a user, thereby controlling the operation of the external apparatus 20.

The controller 100 may control a user image to be stored including a workout history and a workout image about a user. A user may make control while doing a workout, so that information about his/her motion, state, a level of the external apparatus 20, workout change, etc. can be stored in the storage 150 or the external server 30.

The controller 100 may set a user's command as at least one of a voice command and a gesture of a user. For example, a user may want to do a workout more while doing the workout. However, the user cannot always increase the workout conditions like this to do the workout. Therefore, the voice command and the gesture may be used to transmit a command for continuing the workout to the display device 10. Therefore, a command to be issued may be set and stored with regard to each of the voice command and the gesture. The controller 100 may prioritize a user's health conditions, workout conditions, command inputs, etc., and thus may decrease the intensity, speed or the like level of the exercise apparatus 20 even when a user makes a command input for continuing the workout.

Figure 5:
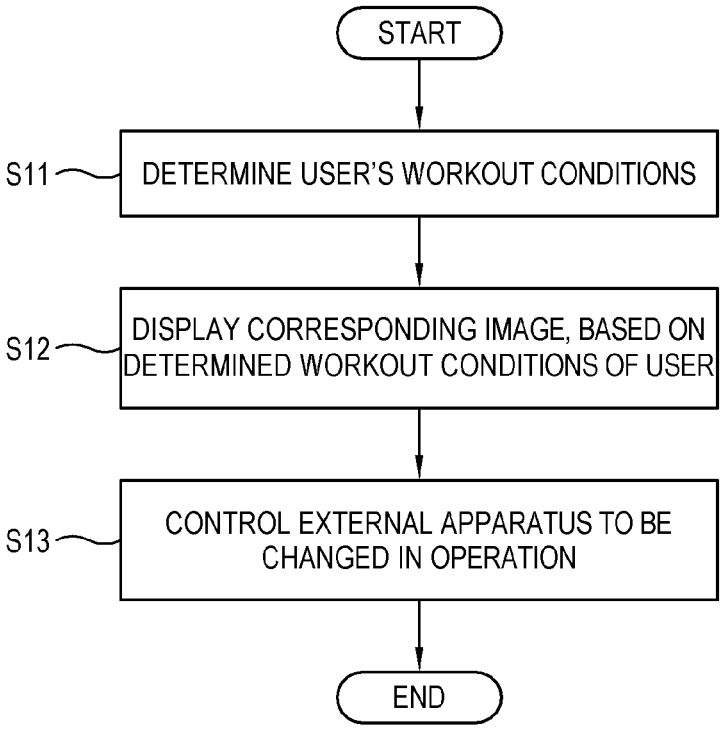
FIG. 5 is a control flowchart of showing a control method of a display device according to the present invention.

FIG. 5 is a control flowchart of showing a control method of a display device 10 according to the present invention.

A user's workout conditions are determined (S11).

An image is displayed corresponding to the determined workout conditions (S12).

The external apparatus is controlled to change its operation (S13).

Figure 6:
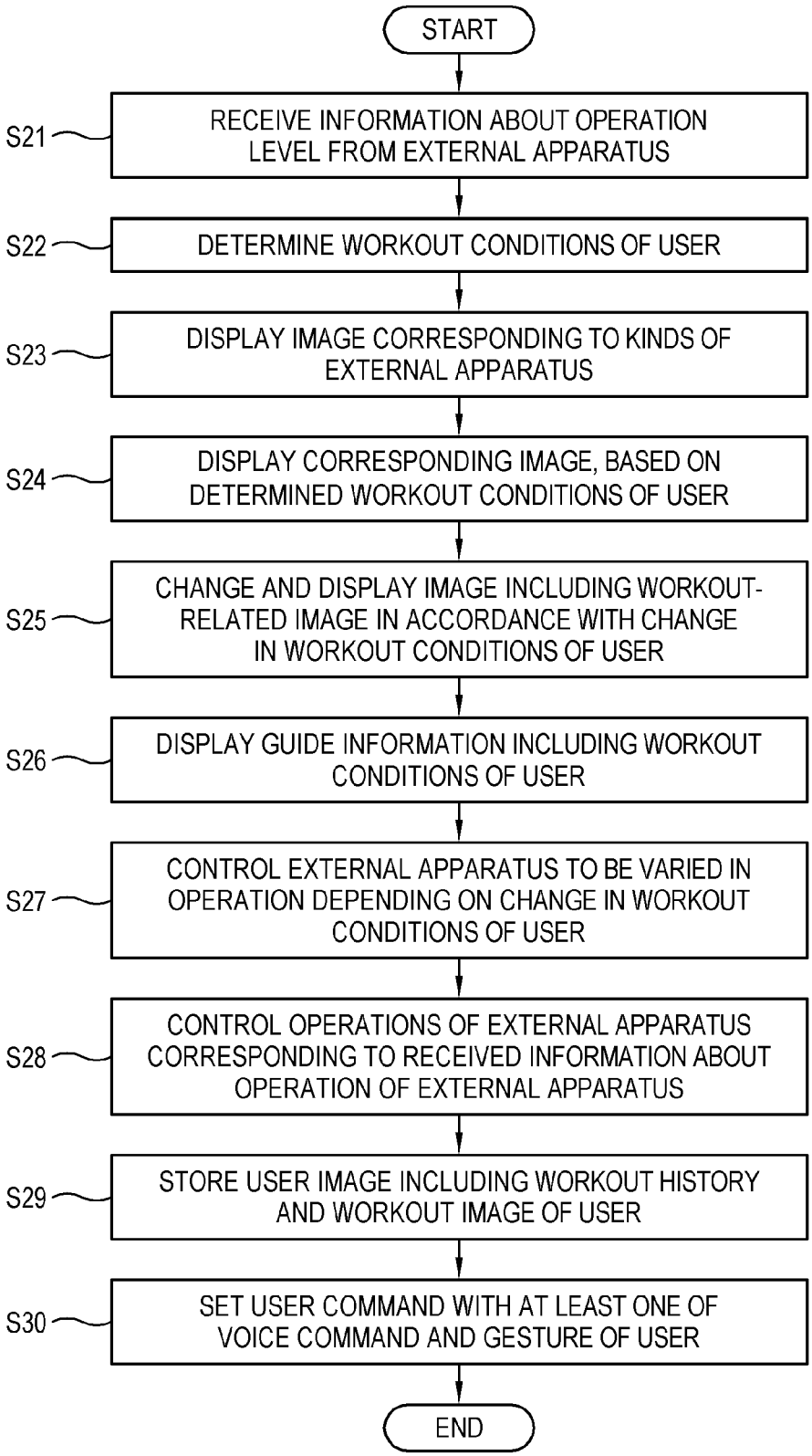
FIG. 6 is a control flowchart of showing a control method of a display device according to one embodiment of the present invention.

FIG. 6 is a control flowchart of showing a control method of a display device 10 according to one embodiment of the present invention.

Information about an operation level is received from an external apparatus 20 (S21).

A user's workout conditions are determined based on the received operation level of the external apparatus 20 (S22).

An image is displayed corresponding to the kind of external apparatus 20 (S23).

A corresponding image is displayed based on at least one of the kind of external apparatus 20 and the determined workout conditions (S24).

An image including a workout-related image is changed and displayed in accordance with change in a user's workout conditions (S25).

Guide information including a user's conditions about a workout is displayed (S26).

The external apparatus 20 is controlled to change operations in accordance with change in the change in a user's workout conditions (S27).

The operations of the external apparatus 20 are controlled corresponding to the received information about the operations of the external apparatus 20 (S28).

A user image is stored including a user's workout history and a workout image (S29).

A user's command is set with regard to at least one of the voice command and gesture of the user (S30).

Figure 7:
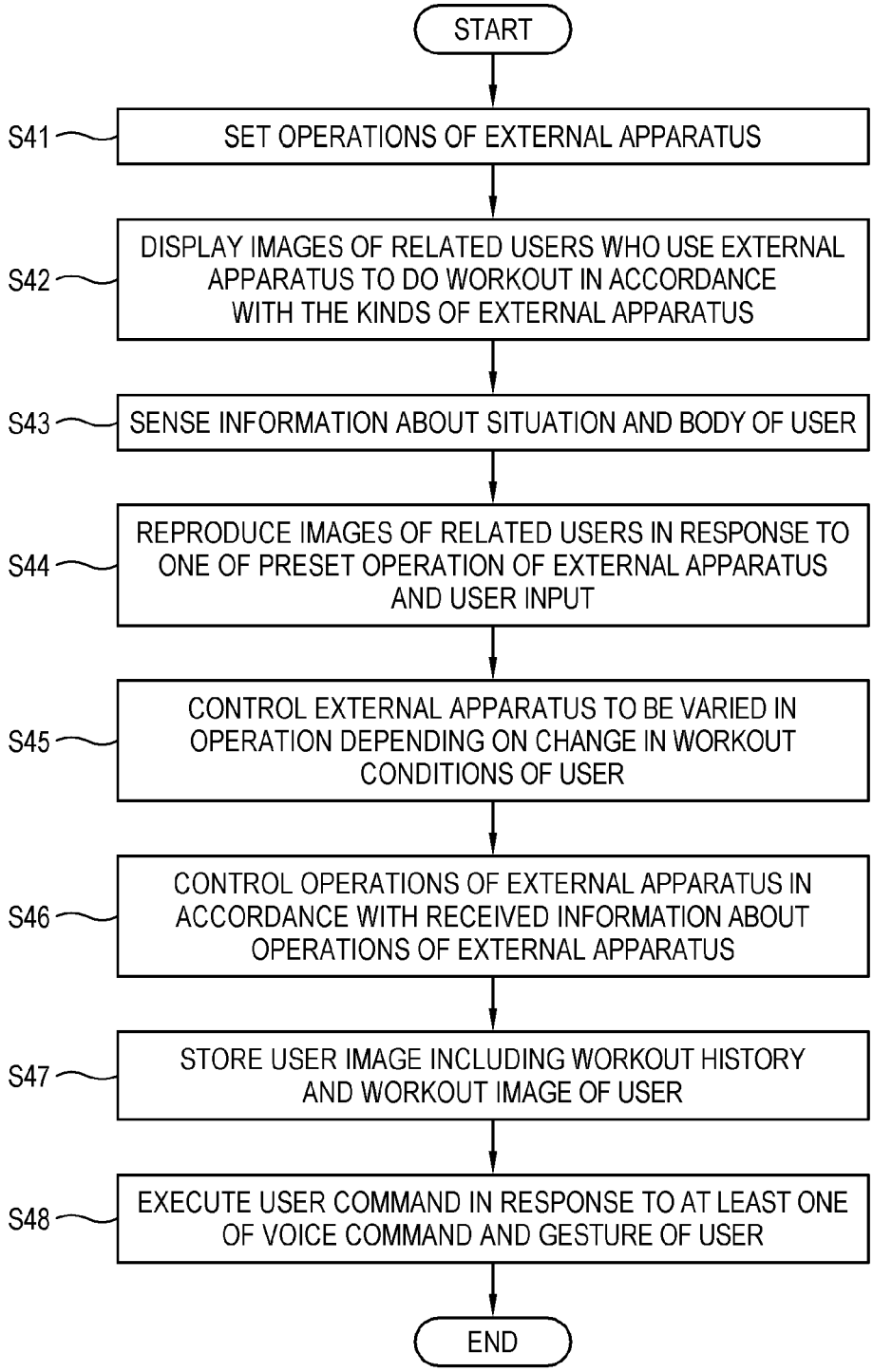
FIG. 7 is a control flowchart of showing a control method of a display device according to another embodiment of the present invention.

FIG. 7 is a control flowchart of showing a control method of a display device 10 according to another embodiment of the present invention, An external apparatus 20 are set with regard to operations (S41).

Information including a user's image related to a workout using the external apparatus 20 is displayed corresponding to the kinds of external apparatus 20 (S42).

At least one of a user's situations and body is sensed (S43).

A related image of a user is reproduced corresponding to one of a preset operation of the external apparatus 20 and a user's input (S44).

The external apparatus 20 is controlled to change operations in accordance with change in a user's workout conditions (S45).

The operations of the external apparatus 20 are controlled corresponding to the received information about the operations of the external apparatus 20 (S46).

A user image is stored including a user's workout history and a workout image (S47). Automatic control may be performed based on analysis of a user's conditions (e.g. workout conditions, and health conditions).

A user's command is executed with regard to at least one of the voice command and gesture of the user (S48).

Figure 8:
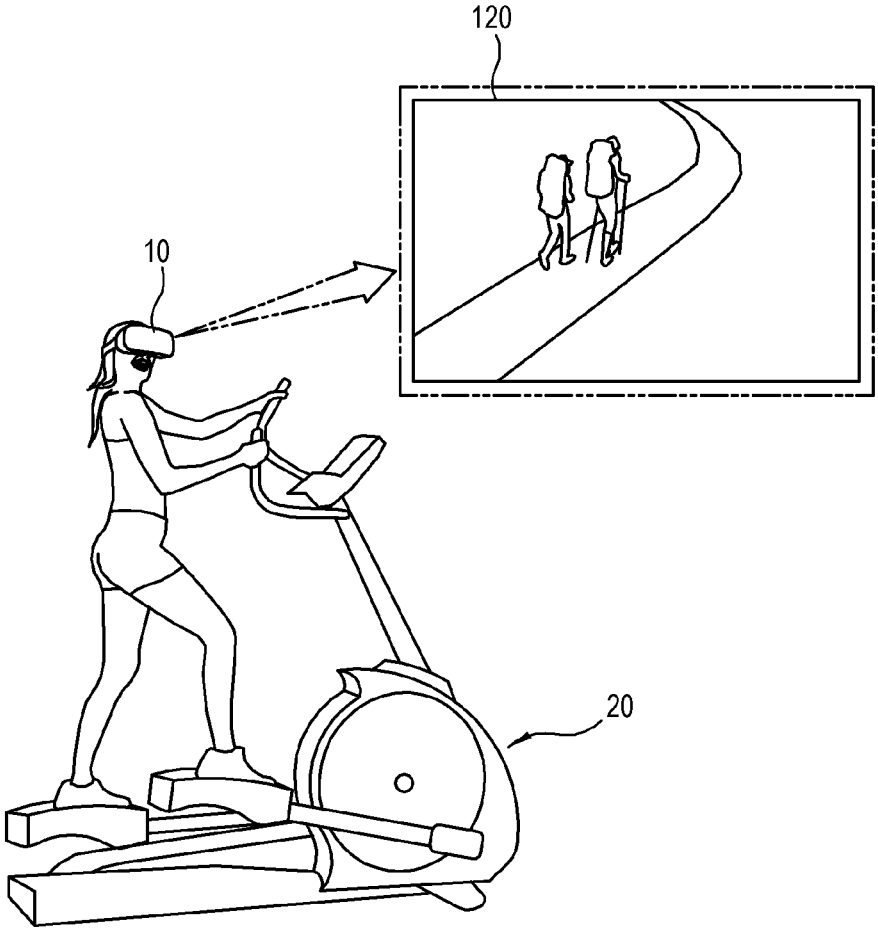
FIG. 8 illustrates an example of a display device according to one embodiment of the present invention when a user does a workout with a low operation level of an exercise apparatus.

FIG. 8 illustrates an example of a display device 10 according to one embodiment of the present invention when a user does a workout with a low operation level of an exercise apparatus.

In a case where a user uses the exercise stepper 20 as if s/he climbs a mountain, the user starts a workout after pairing between the display device 10 and the exercise apparatus 20 and looks at an image of walking on a flatland, which is displayed on the display 120. Thus, a user may feel senses of immersion and realism through the exercise apparatus 20 as if s/he climbs a mountain. A user starts climbing a mountain in accordance with a selected image, and changes the operation level of the exercise apparatus 20 based on the selected image, thereby making settings as if the user actually climbs a mountain.

Figure 9:
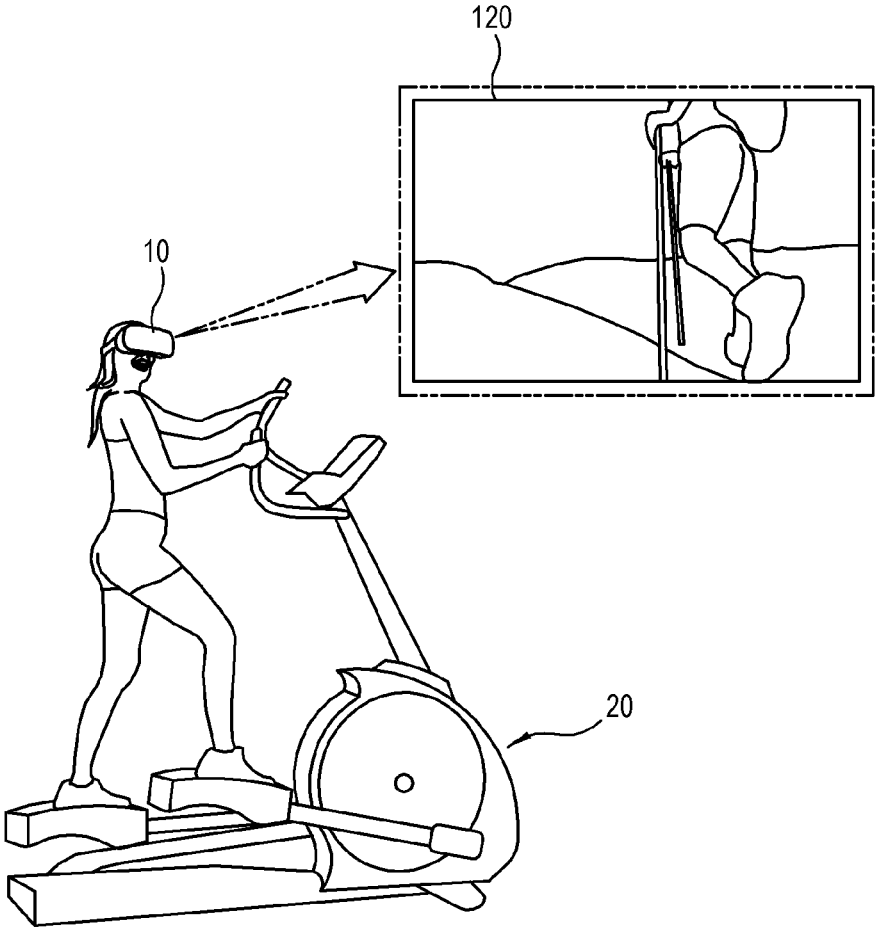
FIG. 9 illustrates an example of a display device according to one embodiment of the present invention when a user does a workout with a middle operation level of an exercise apparatus.

FIG. 9 illustrates an example of a display device 10 10 according to one embodiment of the present invention when a user does a workout with a middle operation level of an exercise apparatus 20.

Referring to FIG. 8, an image of walking on a flatland with the beginning of climbing a mountain is provided. Referring to FIG. 9, an image of going halfway up the mountain is provided. In this regard, the exercise apparatus 20 also operates in the middle operation level. When a user has bad health conditions, at least one of the voice command and gesture may be used to change at least one between the image and the operation level of the exercise apparatus 20.

Figure 10:
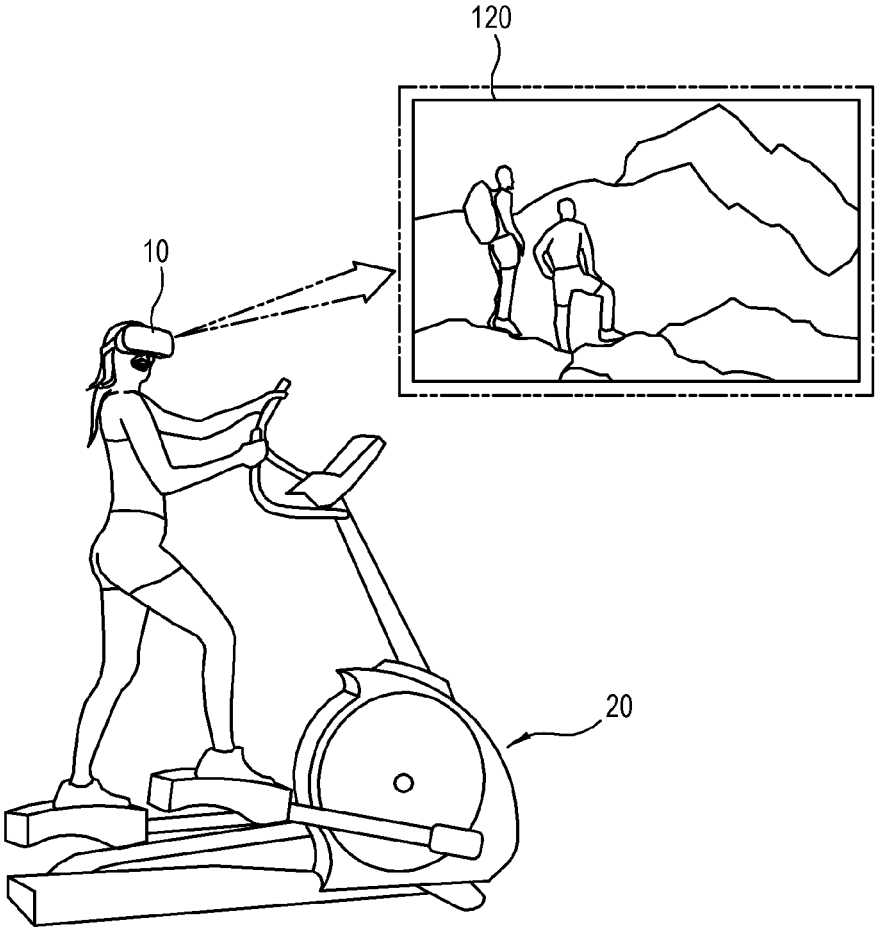
FIG. 10 illustrates an example of a display device according to one embodiment of the present invention when a user does a workout with a high operation level of an exercise apparatus.

FIG. 10 illustrates an example of a display device 10 according to one embodiment of the present invention when a user does a workout with a high operation level of an exercise apparatus 20.

FIG. 8 shows an image of the beginning of climbing the mountain, FIG. 9 shows an image of going halfway up the mountain, and FIG. 10 shows an image of getting to the top of the mountain. Since a steep hill is formed just before the top of the mountain, the exercise stepper 20 may increase in intensity and give a user to feel as if the user climbs the steep hill. The display 120 displays an image of climbing a steep hill. The image shows that a user gets to the top, but is not limited thereto. Alternatively, the display 120 may display an image of showing a scenery viewed from the top.

Figure 11:
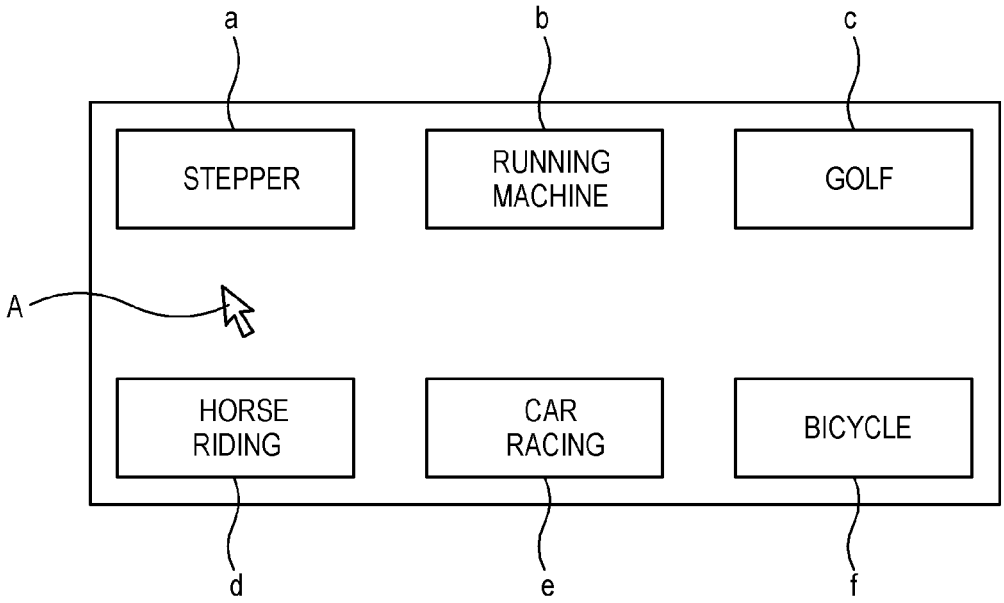
FIG. 11 illustrates an example of a user interface (UI) for showing the kind of workouts selectable in a display device according to one embodiment of the present invention.

FIG. 11 illustrates an example of a user interface (UI) for showing the kind of workouts selectable in a display device 10 according to one embodiment of the present invention.

Although a user can select the exercise apparatus 20 and make pairing the display device 10 and the exercise apparatus 20, the user may execute an application program according to the present invention in the display device 10 so that a plurality of UIs STEPPER (a), RUNNING MACHINE (b), GOLF (c), HORSE (d), CAR RACING (e) and BICYCLE (f) can be displayed to be selected as the exercise apparatus 20 by a user. One among the plurality of UIs STEPPER (a), RUNNING MACHINE (b), GOLF (c), HORSE (d), CAR RACING (e) and BICYCLE (f) in the displayed menu may be selected using a cursor A. A user input may be made using a mouse, and a user's command may be input using the external apparatus, i.e. a user terminal. To input a user's command, a mouse, a user terminal, and a remote controller are used, but not limited thereto. Alternatively, various inputs may be made using a user's voice and gesture.

Figure 12:
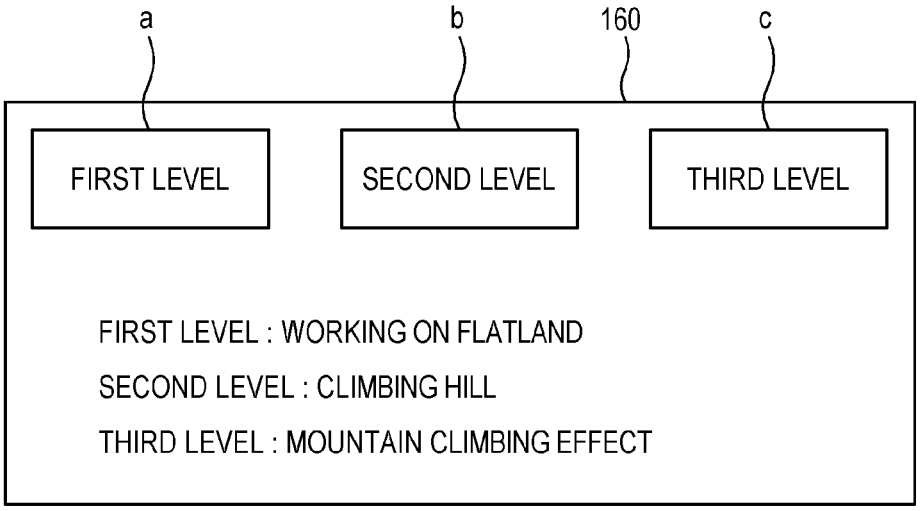
FIG. 12 illustrates an example of a UI for showing workout levels selectable in a display device according to one embodiment of the present invention.

FIG. 12 illustrates an example of a UI for showing workout levels selectable in a display device 10 according to one embodiment of the present invention.

A user may select the exercise stepper as the exercise apparatus 20, and climb a mountain from the bottom to the top. However, a previous workout may be stopped halfway, and the workout may be resumed from where the workout is stopped. Therefore, stepwise workout levels may be provided, so that a user can select the workout level. Referring to FIG. 12, a UI may be provided so that the user input 160 can select a first level a: working on a flatland, a second level b: climbing a hill, and a third level c: a mountain climbing effect.

Figure 13:
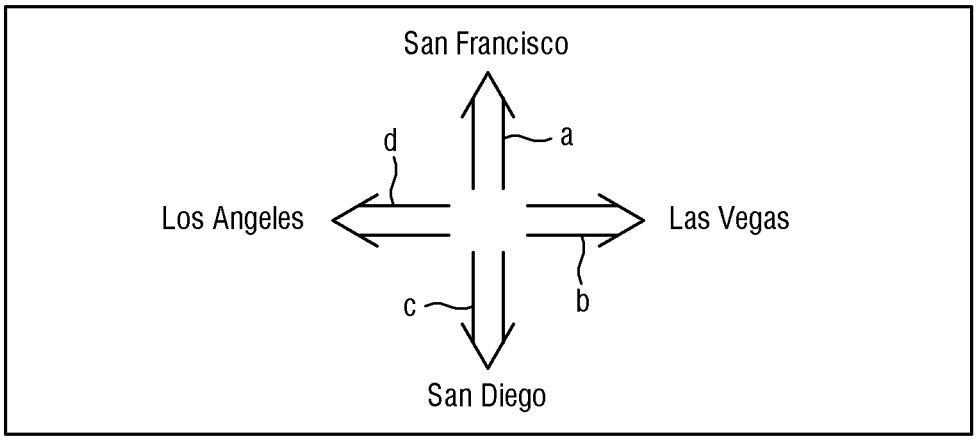
FIG. 13 illustrates an example of a UI for showing climbing routes, i.e. crossroads selectable in a display device according to one embodiment of the present invention.

FIG. 13 illustrates an example of a UI for showing climbing routes, i.e. crossroads selectable in a display device 10 according to one embodiment of the present invention.

When a user selects mountain climbing to do a workout, a mountain may be selectable like selection of the kind of exercise apparatus 20. An image may be provided so that a user can select a mountain, start climbing the mountain, and view a climbing route as if s/he actually climbs the mountain. Further, a user may have to select a climbing route when facing a forked road while moving along the climbing route. In this case, a guideboard may be displayed for allowing a user to select a climbing route. Referring to FIG. 13, the guideboard is displayed with a forward fork (San Francisco) a, a rightward fork (Las Vegas) b, a backward fork (San Diego) c, and a leftward fork (Los Angeles) d at crossroads. When the climbing route is selected, an image and an operation level of the exercise apparatus 20 may be provided corresponding to the selected climbing route.

Figure 14:
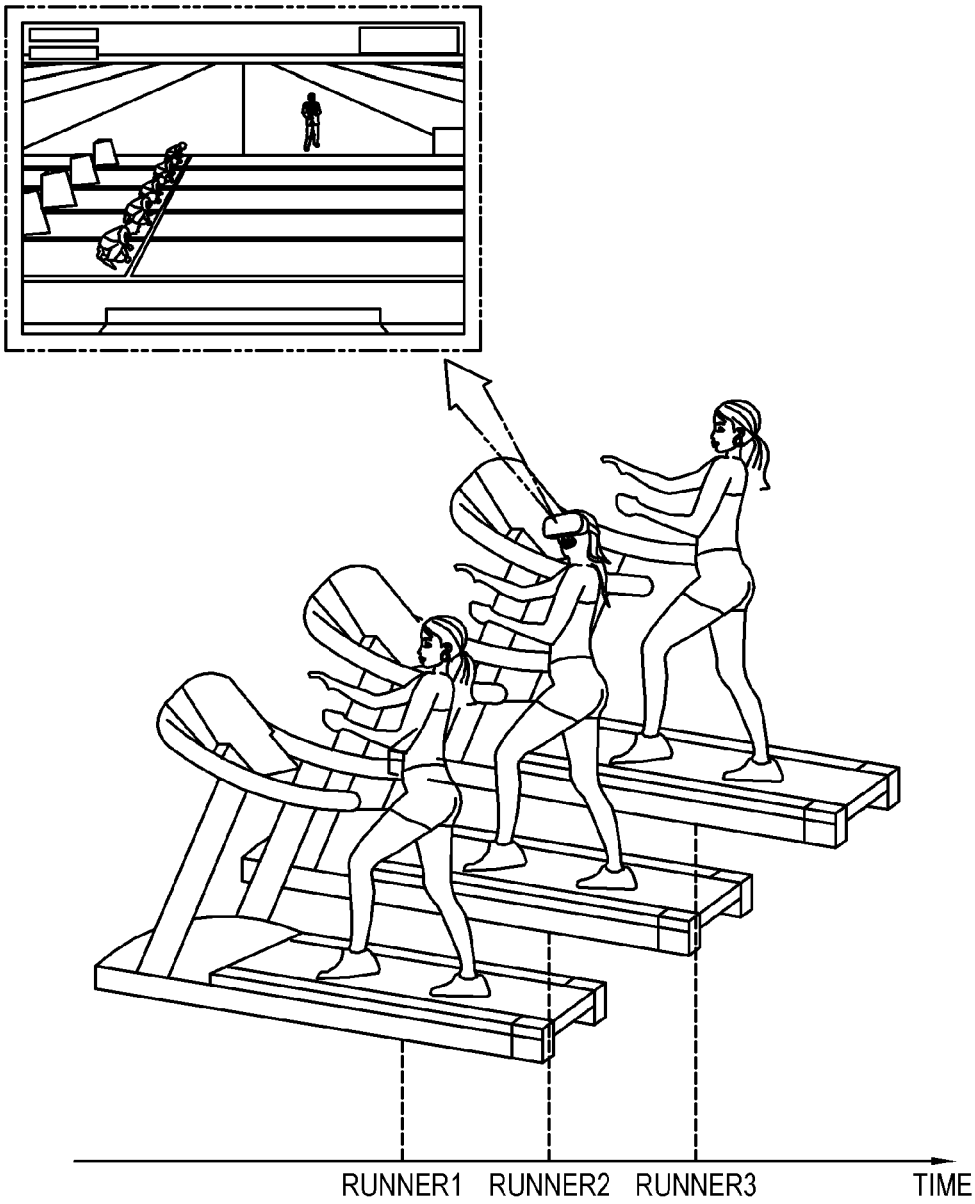
FIG. 14 illustrates an example of an image for showing competition for a running workout between users in a display device according to one embodiment of the present invention.

FIG. 14 illustrates an example of an image for showing competition for a running workout between users in a display device 10 according to one embodiment of the present invention.

A competition mode shows that a user is in competition with a plurality of other users for a workout. Further, the competition mode may allow a user to compete with his/her previous workout image and information.

A user selects a workout for competition, and an image of competition for the determined workout is displayed. Then, an image corresponding to each user is arranged in an competition image, selected among pieces of information about a workout of a plurality of users including the user, i.e. pieces of information such as a workout history, workout conditions, etc., stored in the storage 150 of the display device 10 and the external server. When a user starts the workout after arranging his/her own image, the arranged image of the user is displayed together with the image of the user who is doing a workout with the beginning of the workout stored as it is. When a competition section of the workout is finished, a user may be apprised of the finish and competition results through the display 120. In the competition mode, competition for a workout may be made under the same conditions, or the workout conditions for competition may be varied depending on users with respect to abilities, ages, etc. For example, when eight people including two adult men, two middle school boys, two high school boys and two adult women run a 100 m race, the operation level of the exercise apparatus 20 may be differently applied according to users. When an operation level of '10' is applied for the adult man, the high school boy, the middle school boy and the adult woman have operation levels of '8', '6', and '6', respectively. Such information and image of users may be used in the competition mode, and thus a user can do a workout.

Figure 15:
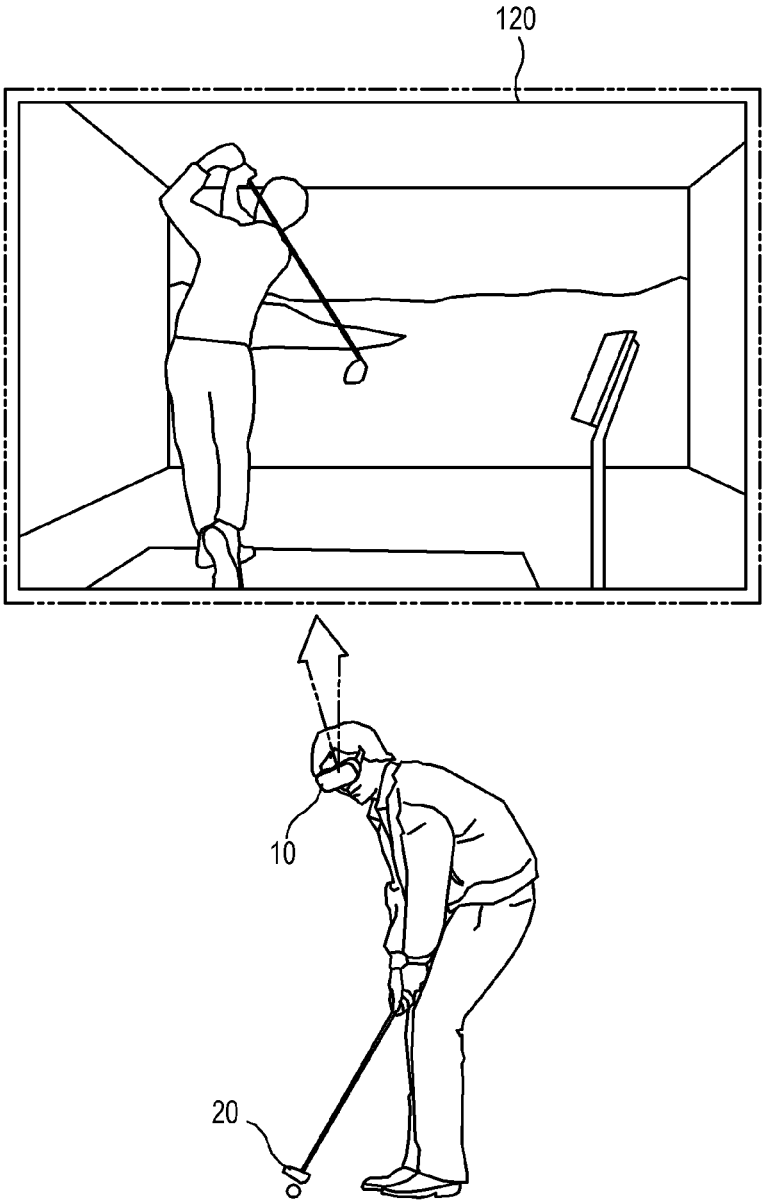
FIG. 15 illustrates an example of an image for allowing a user to play a golf game with another user in a display device according to one embodiment of the present invention.

FIG. 15 illustrates an example of an image for allowing a user to play a golf game with another user in a display device 10 according to one embodiment of the present invention.

It is illustrated that the competition mode allows a plurality of other users to compete for golf. Further, a user may compete with himself/herself based on the image and information about his/her own previous workout.

A user may select golf as a workout for competition, and selects the information and image of a workout rival. With regard to a plurality of users, workout order and rules may be set. Although the images of the rivals are the previously stored images, images in which the plurality of users plays golf may be displayed corresponding to order of hitting a ball, movement, etc. based on distances and golf rules. Alternatively, only a user's own image may be displayed. Thus, the competition mode may be achieved in such a manner that a plurality of users plays golf in order. When a user finishes a golf game, the display device 10 may display game result so that a user can be apprised of the results in detail.

Figure 16:
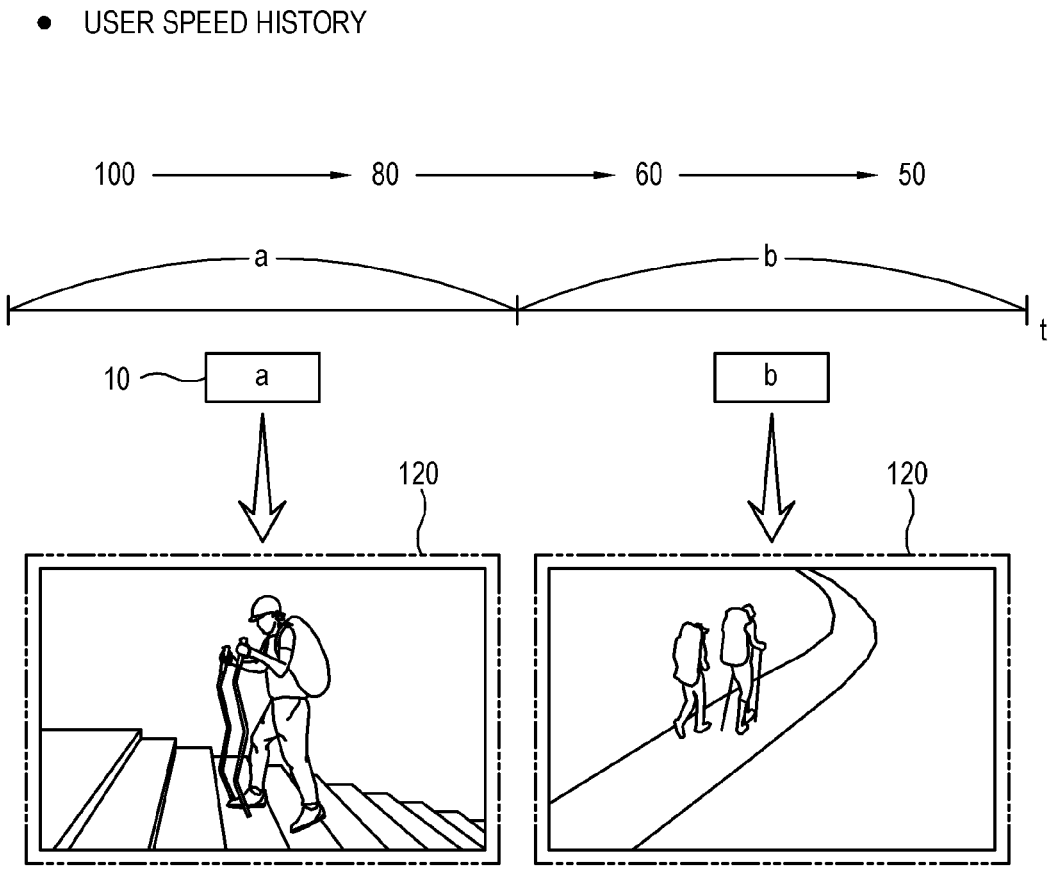
FIG. 16 illustrates an example of images provided suitably for speed histories of users while doing a workout with a display device according to one embodiment of the present invention.

FIG. 16 illustrates an example of images provided suitably for speed histories of users while doing a workout with a display device 10 according to one embodiment of the present invention, While a user is doing a workout with an exercise apparatus 20, the exercise apparatus 20 may continuously transmit the operation level to the display device 10. The display device 10 may determine the workout conditions of the user based on change in the received operation level of the exercise apparatus 20. As shown in FIG. 16, a user has an initial speed of '100', but the speed is sequentially changed into '80', '60' and '50'. Regarding the change, the workout speed of the user may be divided into a section a and a section b according to workout timeslots. In the section a, the workout speed of the user is high and the display 120 displays an image in which the user goes up stairs to climb a mountain. In the section b, the workout speed of the user is low and an image in which the user goes down the mountain on a descent is displayed.

Figure 17:
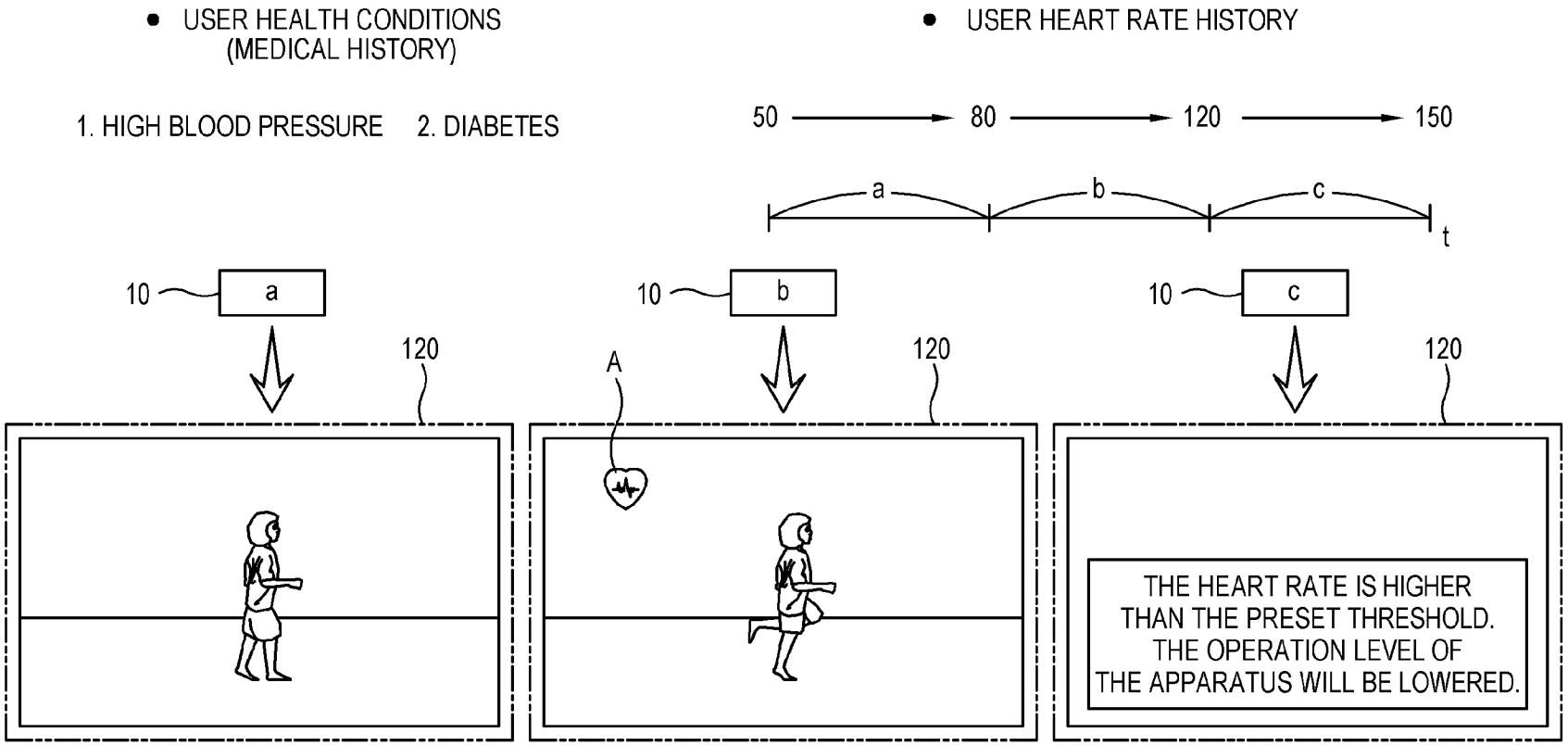
FIG. 17 illustrates images and guide information provided corresponding to health conditions of a user while doing a workout with a display device according to one embodiment of the present invention.

FIG. 17 illustrates images and guide information provided corresponding to health conditions of a user while doing a workout with a display device 10 according to one embodiment of the present invention.

The storage 150 of the display device 10 may be configured to store information about a user's medical history and health conditions. Referring to FIG. 17, a user's medical history shows high blood pressure and diabetes, the user's heart rate sensed by the sensor 140 is changed from '50' into '80', '120' and '150' in sequence, and the change in the heart rate is divided into a section a from '50' to '80', a section b from '80' to '120', and a section c from '120' to '150' according to the timeslots The images respectively corresponding to the sections a, b and c may be provided to the user. In the section a, an image of slowly walking on a flatland, i.e. a hiking image may be displayed. In the section b, an image of slowly running on the flatland may be displayed together with an image A which is located at a left upper side of the display 120 as an initial guide to inform the user who has the high blood pressure that a heavy workout is dangerous and the heart rate increases. The image A may include any image as long as it shows change in the heart rate and serves as the initial guide of informing that an intense workout is dangerous. In the section c, a warning guide is displayed as the user who has the medical histories of high blood pressure and diabetes is currently doing a heavy workout. A user may previous set the threshold of the heart rate for his/her workout. Therefore, a guide of "The heart rate is higher than the preset threshold. The operation level of the apparatus will be lowered." May be displayed, and a control signal for lowering the operation level may be transmitted to the exercise apparatus 20.

Figure 18:
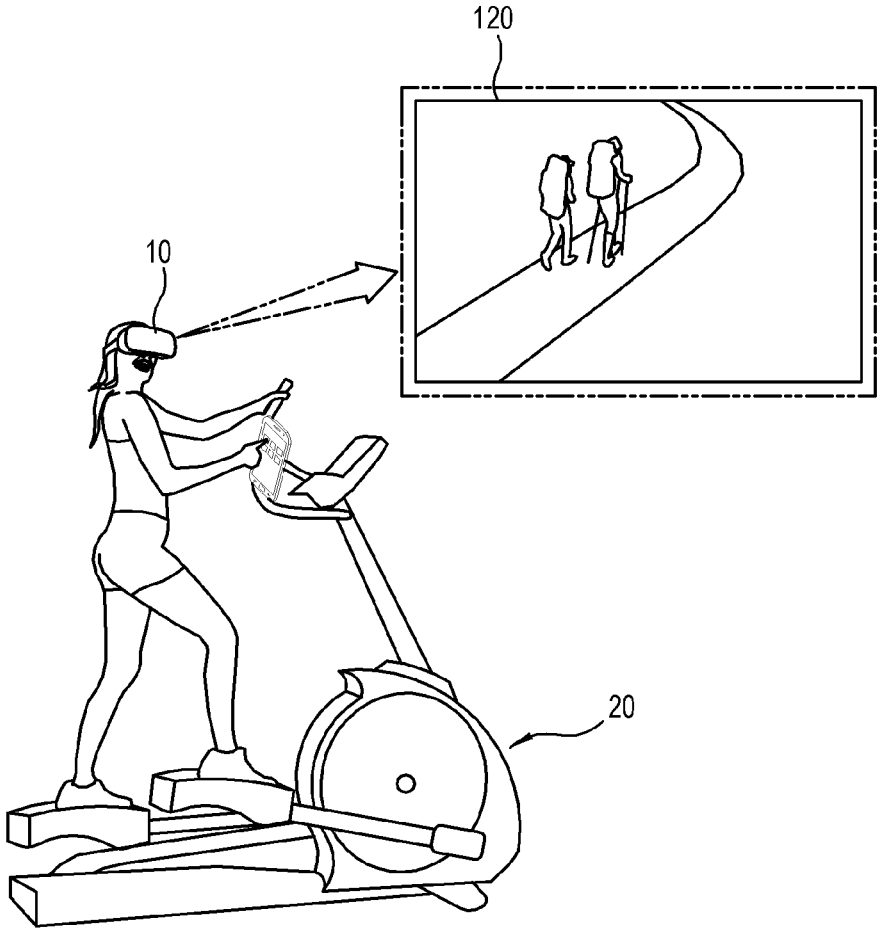
FIG. 18 illustrates an example of selecting a menu of a display device while doing a workout with the display device according to one embodiment of the present invention.

FIG. 18 illustrates an example of selecting a menu of a display device 10 while doing a workout with the display device 10 according to one embodiment of the present invention.

A user may make control for executing an application program according to the present invention and selecting a UI. However, the display device 10 is provided in the form a pair of glasses and mounted to a user's head, and it is thus difficult not easy to do a touching or selecting operation. Therefore, a user may make pairing between his/her terminal and the display device 10 so as to select and control various menus. The display 120 is capable of transmitting/blocking the external light, and thus allows a user to view and control the user terminal, so that a user's operation of touching the user terminal can be synchronized with the display device and displayed and selected as the image. In the foregoing embodiments, the user terminal is used to receive a user's input. However, various input tools may be employed to make an input.

With the foregoing display device 10, the operation level of the exercise apparatus is varied depending on a user's workout conditions, and an image corresponding to the user's workout conditions is provided so that the user can feel senses of immersion and realism. The display device 10 displays an image based on information about a plurality of other users or a user's own previous workout, so that the user can relish a workout through competition.

Although the present invention has been described with the limited and exemplary embodiments and drawings, the present invention is not limited to the foregoing exemplary embodiments, and various changes and modifications can be made from these descriptions by a person having an ordinary skilled in the art to which the present invention pertains. Therefore, the scope of the invention has to be defined in the appended claims and their equivalents without limitations to the described exemplary embodiments.

What is claimed is:

1. A wearable display device comprising:

a communicator configured to communicate with an external apparatus operable for a workout of a user;

a display;

a memory configured to store a program; and a controller, by executing the program stored in the memory, being configured to:

obtain a workout speed of the user;

based on the obtained workout speed of the user being slower, control the communicator to transmit a control signal to the external apparatus for decreasing an operation speed of the external apparatus; and control the display to display an image based on the decreased operation speed of the external apparatus.

2. The wearable display device according to claim 1, wherein the controller is configured to obtain the workout speed of the user based on operation level information of the external apparatus received from the external apparatus.

3. The wearable display device according to claim 1, further comprising a sensor configured to sense situations of the user, wherein the controller is configured to obtain the workout speed of the user based on the situations of the user sensed by the sensor.

4. The wearable display device according to claim 1, wherein the displayed image differs for different types of external apparatuses.

5. The wearable display device according to claim 1, wherein the displayed image comprises guide information including the obtained workout speed.

6. The wearable display device according to claim 1, wherein the controller is configured to control an operation level of the external apparatus to vary based on changes in the obtained workout speed of the user.

7. The wearable display device according to claim 1, further comprising a head-mounted display device (HMD).

8. A method of controlling a wearable display device, the method comprising:

obtaining, by the wearable display device, a workout speed of a user;

based on the obtained workout speed of the user being slower, transmitting a control signal to an external apparatus operable for a workout of the user, the control signal usable by the external apparatus for decreasing an operation speed of the external apparatus; and displaying an image based on the decreased operation speed of the external apparatus.

9. The method according to claim 8, wherein the workout speed of the user is obtained based on operation level information of the external apparatus received from the external apparatus.

10. The method according to claim 8, wherein the workout speed of the user is obtained based on situations of the user sensed by a sensor.

11. The method according to claim 8, wherein the displayed image differs for different types of external apparatuses.

12. The method according to claim 8, wherein the displayed image comprises guide information including the obtained workout speed of the user and health conditions of the user.

13. The method according to claim 8, further comprising controlling an operation level of the external apparatus to vary depending on changes in the obtained workout speed of the user.

* * * * *